US007849560B2

(12) United States Patent
Kelley

(10) Patent No.: US 7,849,560 B2
(45) Date of Patent: Dec. 14, 2010

(54) SELF-ADJUSTING WINDOW ROLLER APPARATUS AND METHOD OF USE

(76) Inventor: Traci L. Kelley, 23171 Via Celeste, Coto de Caza, CA (US) 92679

( * ) Notice: Subject to any disclaimer, the term of this patent is extended or adjusted under 35 U.S.C. 154(b) by 326 days.

(21) Appl. No.: 12/175,912

(22) Filed: Jul. 18, 2008

(65) Prior Publication Data

US 2009/0019665 A1 Jan. 22, 2009

Related U.S. Application Data

(60) Provisional application No. 60/950,538, filed on Jul. 18, 2007.

(51) Int. Cl.
*A47H 15/00* (2006.01)

(52) U.S. Cl. ..... 16/105; 16/99; 16/97; 16/106

(58) Field of Classification Search ..... 16/91, 16/97, 99, 102, 105–107; 49/425, 421, 420; 160/345, 346, 347
See application file for complete search history.

(56) References Cited

U.S. PATENT DOCUMENTS

| | | | | | |
|---|---|---|---|---|---|
| 3,237,238 | A | | 3/1966 | Anderson | |
| 3,402,483 | A | * | 9/1968 | Hans et al. | 434/420 |
| 3,696,560 | A | | 10/1972 | Hallin | |
| 3,959,849 | A | * | 6/1976 | Marquardt | 16/105 |
| 3,996,643 | A | | 12/1976 | Steigerwald | |
| 4,194,266 | A | | 3/1980 | Natzel | |
| 4,262,451 | A | | 4/1981 | Dallaire | |
| 4,696,583 | A | * | 9/1987 | Gorges | 384/49 |
| 4,873,741 | A | * | 10/1989 | Riegelman | 16/105 |
| 5,018,263 | A | | 5/1991 | Stern | |
| 5,018,306 | A | * | 5/1991 | Prevot | 49/425 |
| 5,161,330 | A | * | 11/1992 | Auriemma | 49/420 |
| 5,287,655 | A | | 2/1994 | Harvey | |
| 5,343,594 | A | | 9/1994 | Harvey | |
| 5,791,089 | A | | 8/1998 | Prevot et al. | |
| 5,845,363 | A | * | 12/1998 | Brempell et al. | 16/105 |
| 5,950,279 | A | * | 9/1999 | Chaput | 16/105 |
| 6,021,547 | A | | 2/2000 | Stagoll | |
| 6,026,612 | A | | 2/2000 | Strassel et al. | |
| 6,526,625 | B2 | | 3/2003 | Becken | |
| 6,681,445 | B2 | | 1/2004 | Huang | |
| 2007/0017065 | A1 | | 1/2007 | Hutnik et al. | |

* cited by examiner

*Primary Examiner*—Chuck Y. Mah
(74) *Attorney, Agent, or Firm*—Mind Law Firm; Jeromye V. Sartain; Justin G. Sander

(57) ABSTRACT

A window roller apparatus comprising a cradle, a housing pivotably installed in the cradle, and at least one roller wheel rotatably installed in the housing. Cradle side walls are formed with opposite inwardly-opening cradle side wall recesses, and respective housing side walls are formed with opposite inwardly-opening housing side wall recesses and with opposite outwardly-projecting bosses configured to pivotably engage the respective inwardly-opening cradle side wall recesses. The at least one roller wheel has an axle that engages the housing side wall recesses. A resilient pad is positioned on the cradle bottom wall between the cradle and the housing, the pad being of a sufficient size and thickness to at least partially engage the housing and effectively bias the housing toward a parallel orientation relative to the cradle while allowing for non-parallel operation of the housing relative to the cradle as dictated by operational constraints on the window roller apparatus.

10 Claims, 5 Drawing Sheets

SELF-ADJUSTING WINDOW ROLLER APPARATUS AND METHOD OF USE

RELATED APPLICATIONS

This application claims priority and is entitled to the filing date of U.S. Provisional application Ser. No. 60/950,538 filed Jul. 18, 2007, and entitled "Self-Adjusting Window Roller Pendulum Cartridge." The contents of the aforementioned application are incorporated by reference herein.

INCORPORATION BY REFERENCE

Applicant hereby incorporates herein by reference any and all U. S. patents and U.S. patent applications cited or referred to in this application.

BACKGROUND OF THE INVENTION

1. Field of the Invention

Aspects of this invention relate generally to rollers, and more particularly to window rollers.

2. Description of Related Art

There are many types of door and window roller assemblies available in the marketplace currently. However, all such known assemblies require manual adjustment of the roller wheels or otherwise involve relatively complex components to allow for different height and thus clearance positions. The purpose of such door and window rollers is to allow the door or window sliding sash to roll or slide smoothly from side to side in a track. Such roller assemblies may include one, two, or three or more wheels, some being made of brass or nylon or other materials, some having ball bearings, and some being solid. These wheels are then typically installed in a rigid cartridge that has more than one positioning slot per wheel. In the case of window sashes that do not slide properly, for example, the sash must be removed, these wheels removed and reinstalled in different pre-slotted positions that will raise or lower the wheel as needed, and the sash then replaced within the window frame. Further steps may include the removal and replacement of the cartridge or carrier in which the one or more wheels are installed, in addition to removing and replacing the wheel(s) within the carrier. Or, instead of placing the wheels in different slots once they or the carrier they operate in are removed, the relative height adjustment of the wheels may be manually made by screws, cams, etc. The non- or poor-sliding operation of a door or window necessitating the kind of adjustment described above is often brought about due to a variety of conditions such as the doors or windows being manufactured out of square or being installed out of square relative to the frame, movement of the frame after installation and use due to normal "wear and tear," settling of the structure in which the door or window is installed, or ground movement, or the accumulation of dirt, dust and/or debris in the door or window frame or window sash track.

The following art defines the present state of this field:

U.S. Pat. No. 3,237,238 to Anderson is directed to roller assemblies for movable closure members such as sliding doors and, more particularly, to roller assemblies mountable on the door for adjustment relative thereto to square the door in its frame opening and adjust the clearances at the edges of the door. The exemplary roller assembly is adapted to be mounted adjacent the lower edge of a sliding door and including at least one roller for engaging a track which supports and guides the door for back and forth movement between open and closed positions in an opening in the frame. Usually two such roller assemblies are spaced apart along the lower edge of the door with one adjacent each upright edge of the door. Each roller assembly is mounted on a frame in the form of a case recessed into the lower door edge in a pocket with the roller supported within the case on a carrier. The carrier is mounted and supported in the case for quick and easy adjustment of the level of each roller relative to the door to effect the squaring and height adjustment. To this end, the assembly includes co-acting cam and follower elements on the carrier and on the case operable upon movement of the cam to shift the carrier downwardly or upwardly in the case. The cam is movable by manually operable means easily accessible from the side of the door in all positions of the latter, and the cam and follower are shaped to shift the carrier step by step in each direction by predetermined increments and to hold the carrier securely but releasably in each selected position.

U.S. Pat. No. 3,696,560 to Hallin is directed to a movable panel supported in a frame for horizontal travel, said panel mounting a movable structure for limited horizontal movement therein and defining horizontally spaced and oppositely inclined planes, and an insert rigidly mounted in said panel and defining plane engaging surfaces adapted to engage said planes for relative movement equally up and down proportional to the relative horizontal movement of said movable structure and the fixed insert.

U.S. Pat. No. 3,996,643 to Steigerwald is directed to a roller wheel assembly for a sliding closure having a wheel unit which is supported in a frame for vertical motion relative thereto when the assembly is installed in the closure. Means in the form of a wedge assembly which engages sloped surface means in the wheel unit are provided to vertically adjust the wheel unit relative to the track. The wedge assembly is adjusted sidewise by means of a screw assembly which is operated from the side of the frame. This causes wedge shaped surfaces of the wedge assembly to ride along the sloped surface means to afford a continuous and precise vertical adjustment of the wheels.

U.S. Pat. No. 4,194,266 to Natzel is directed to an adjustable roller mechanism for a sliding closure having a case attachable to the sliding closure and a roller-mounting bracket mountable thereon for adjustable movement to varying positions extending from the case. A smooth surfaced cam is rotatably mounted to control the adjusted position of the roller bracket and a modified planocentric gear assembly operable by manually rotating a mounting shaft provides a gear reduction drive for rotation of the cam and for automatically locking the cam in any rotative position.

U.S. Pat. No. 4,262,451 to Dallaire is directed to a roller assembly which is adapted to be snapped into and out of a channel of a sliding frame closure which device is used to adjust the effective height of the closure relative to an aperture frame in which it is installed. The roller assembly or device comprises an outer stationary frame member having a pair of correspondingly positioned canted slots formed therein and means provided on the outer frame member to permit frictional and mechanical engagement of the assembly within the channel of the sliding frame closure; an inner frame member adapted to be mounted within the outer frame member and having at least one roller wheel fixedly mounted therein for rotation about its axis; the inner frame member being mounted for vertical movement within the outer frame member by means of a transverse pin which extends through the canted slots of the outer frame member; the inner frame member being secured by adjustment means to the outer frame member such that on tightening of the adjustment means, the transverse pin secured through the inner frame member slides down the canted slot moving the roller wheel vertically downward and reverse movement occurs on loosening of the adjustment means. Also described is the combination of at least one of the roller assemblies and a sliding frame closure.

U.S. Pat. No. 5,018,263 to Stem is directed to a one-piece sealed, hollow, steel sliding screen door frame and method of fabrication thereof. A flat steel strip is diecut to produce 45° miter cuts, each having an opposing flap. The cut strip is rolled to produce a frame stock having an essentially rectangular profile. Longitudinal edges of the strip are folded together, crimped and bonded during the rolling and form a screen channel in the frame stock. The frame stock is bent at right angles at the miter cuts such that the flaps tuck under the miter cuts, forming a rectangular door frame. Epoxy is used to bond the flaps to the inner surfaces adjacent the miter cuts. A screen door assembled using the door frame includes self-centering wheel assemblies.

U.S. Pat. No. 5,287,655 to Harvey is directed to a sliding panel that includes a frame having top, bottom and side members. Expanders rotatably supporting rollers are partially disposed within the top and bottom members and are displaceable against spring tension inwardly and outwardly of said members. Clips are provided for retaining the expanders partially disposed within the top and bottom members and for limiting the outward displacement of the expanders. The arrangement described provides self-leveling of the rollers along the entire width of the panel.

U.S. Pat. No. 5,343,594 to Harvey is directed to a sliding panel that includes top, bottom and side members. A corner roller arrangement has integral corner keys, whereby a corner member abuts the ends of the panel members at each of the corners thereof. Each of the corner members includes a spring biased roller whereby the rollers are self-leveling at each of said corners. A clip is arranged to adjust the roller to a plurality of inwardly and outwardly extensions relative to the top and bottom panel members. The arrangement is such that the corner members are effective as an installation guide for the sliding panel and impart an anti-rattle feature thereto.

U.S. Pat. No. 5,791,089 to Prevot et al. is directed to a rolling device for a sliding leaf (2) of a door or window and having a slide (7) aimed at being accommodated in the slit (24) provided for in the lower edge (23) of a profile (4) defining the lower rail (3) of the leaf (2), this slide (7) resting against a metallic reinforcement (6) or a horizontal wall (44) located in the inner portion (5) of the profile (4). The slide (2) is also provided with a hooking-in member (27, 28), cooperating with the transversal edges (29, 30) of the slit (24), defined by a horizontal rim (31) at the level of its transversal ends (17, 17A), at least one horizontal rim (31) being subjected to springy restoring member (33) allowing to withdraw the hooking-in member (27) in order to allow the passing through, by snapping in, of this latter, and its removal, the hooking-in member (27, 28) being completed by a retaining member (47) capable of vertically immobilizing the rolling device (1) in the slit (24) of the profile (4).

U.S. Pat. No. 6,021,547 to Stagoll is directed to an adjustment mechanism for adjusting a support means such as wheels (5*a*, 5*b*) relative to a housing structure (2, 3) retaining said wheels (5*a*, 5*b*), the adjustment mechanism including a screw member (7) selectably movable in a direction (22) transverse to the intended adjusting movement direction (6) of said wheels (5*a*, 5*b*), the movement of said screw member (7) acting to move an adjustment member or members (9, 9*a*, 9*b*) in a direction perpendicular to said directions (6) and (22) with movement of said adjustment member or members causing movement of said wheels (5*a*, 5*b*) in said adjusting movement direction (6).

U.S. Pat. No. 6,026,612 to Strassel et al. is directed to an apparatus having a sliding leaf, a slide member, at least two rail wheels mounted on respective spindles, a mounting mechanism affixed to the slide member and extending in a direction perpendicular to a plane of the sliding leaf, and fixing lugs affixed to and extending outwardly from a lower edge of the slide member at respective ends of the slide member. The slide member is a casing having two sets of recesses. The recesses in each set of recesses increase in height from a center of the casing to a respective end of the casing. The recesses in each set extend from the lower edge of the casing towards an upper wall of casing. The spindles have ends received by respective recesses of the two sets of recesses. The recesses have a narrowing so as to lock onto a respective end of the spindles. The casing is secured in a slot formed in a lower edge of the sliding leaf. The mounting mechanism enables the casing to rock within the slot. The mounting mechanism is a boss interposed between a bottom of the slot and the upper wall of the casing. The fixing lugs are formed of a flexible and spring material. The fixing lugs are affixed to the lower edge of the sliding leaf.

U.S. Pat. No. 6,526,625 to Becken is directed to a wheel or roller assembly for a patio door or the like comprising a carriage having two parallel spaced side plates and a pair of grooved wheels mounted within the carriage that provide for the self adjustment of the roller wheels as while the wheels are adjusted. Also, while the roller wheels are being adjusted, the assembly provides an enhancement that will prevent the wheels from rocking out of level orientation in the full wheels up position.

U.S. Pat. No. 6,681,445 to Huang is directed to a pulley set that includes a base, a seat, and an adjusting unit, wherein the base defines a hollow space with one side of the hollow space forming a vertical wall having a screw hole and the other side of the hollow space forming an inclined wall. A guiding plane parallel to the inclined wall extends from the vertical wall, and positioning slots are respectively formed in the guiding plane and the inclined wall. The seat is mounted within the hollow space of the base and has two inclined planes corresponding to the inclined wall and the guiding plane. The adjusting unit is disposed in the screw hole of the base for pushing against the seat such that adjusting the adjusting unit will cause the seat to move along the inclined wall and the guiding plane of the base.

U.S. Patent Application Publication No. 2007/0017065 to Hutnik et al. is directed to a door roller system. The door roller system comprises a first housing including at least one generally vertical side member having at least one slot; a base slidably coupled to the first housing and having at least one projection that extends at least partially through the slot; and at least one wheel coupled to the base. The projection on the base is configured to slide within the slot on the first housing as the base is moved relative to the first housing.

The prior art described above teaches an adjustable roller assembly, an adjustable aligning apparatus for movable panels, a roller wheel assembly for a sliding closure, an adjustable roller mechanism, a roller assembly for a sliding frame closure, a method for making a metal screen door frame, a roller arrangement for sliding panels, a corner roller arrangement for sliding panels, a rolling device for a sliding leaf of a door window or the like, a door adjustment mechanism, a rolling device having a plurality of recesses for adjusting a level of a sliding leaf, an enhanced performance tandem roller for patio doors, a pulley set for doors and windows, and a door roller system, but does not teach a self-adjusting window roller apparatus and method of use. Aspects of the present invention fulfill these needs and provide further related advantages as described in the following summary.

SUMMARY OF THE INVENTION

Aspects of the present invention teach certain benefits in construction and use which give rise to the exemplary advantages described below.

In a first aspect of the window roller apparatus of the present invention, a housing is pivotably installed in a cradle through the engagement of opposite outwardly-projecting bosses formed on the housing with respective opposite inwardly-opening cradle side wall recesses.

In a further aspect of the invention, the cradle is formed having substantially parallel cradle side walls formed with opposite inwardly-opening cradle side wall recesses, and the housing is formed having substantially parallel housing side walls formed with opposite outwardly-projecting bosses configured to pivotably engage the respective inwardly-opening cradle side wall recesses such that the housing is pivotably installed in the cradle.

In a yet further aspect of the invention, the housing side walls are formed with first and second sets of opposite inwardly-opening housing side wall recesses, and first and second roller wheels each having first and second axles are rotatably installed in the housing through engagement of the first and second axles with the respective first and second sets of housing side wall recesses.

In a yet further aspect of the invention, the cradle side walls are interconnected by a cradle bottom wall, and a resilient pad is positioned on the cradle bottom wall between the cradle and the housing, the pad being of a sufficient size and thickness to at least partially engage the housing, whereby the housing is freely pivotable relative to the cradle within the limitations of at least the pad, the pad effectively biasing the housing toward a parallel orientation relative to the cradle while allowing for non-parallel operation of the housing relative to the cradle as dictated by operational constraints on the window roller apparatus.

In a still further aspect of the invention, the cradle side walls are further interconnected by opposite spaced-apart cradle end walls each being formed at an inclined obtuse cradle end wall angle relative to the cradle bottom wall, and the housing side walls are further interconnected by a housing bottom wall and opposite spaced-apart housing end walls, the housing end walls each being formed at an inclined obtuse housing end wall angle relative to the housing bottom wall, whereby during operation of the window roller apparatus the range of pivoting motion of the housing relative to the cradle is absolutely limited in either direction through engagement of the housing end walls with the respective cradle end walls.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
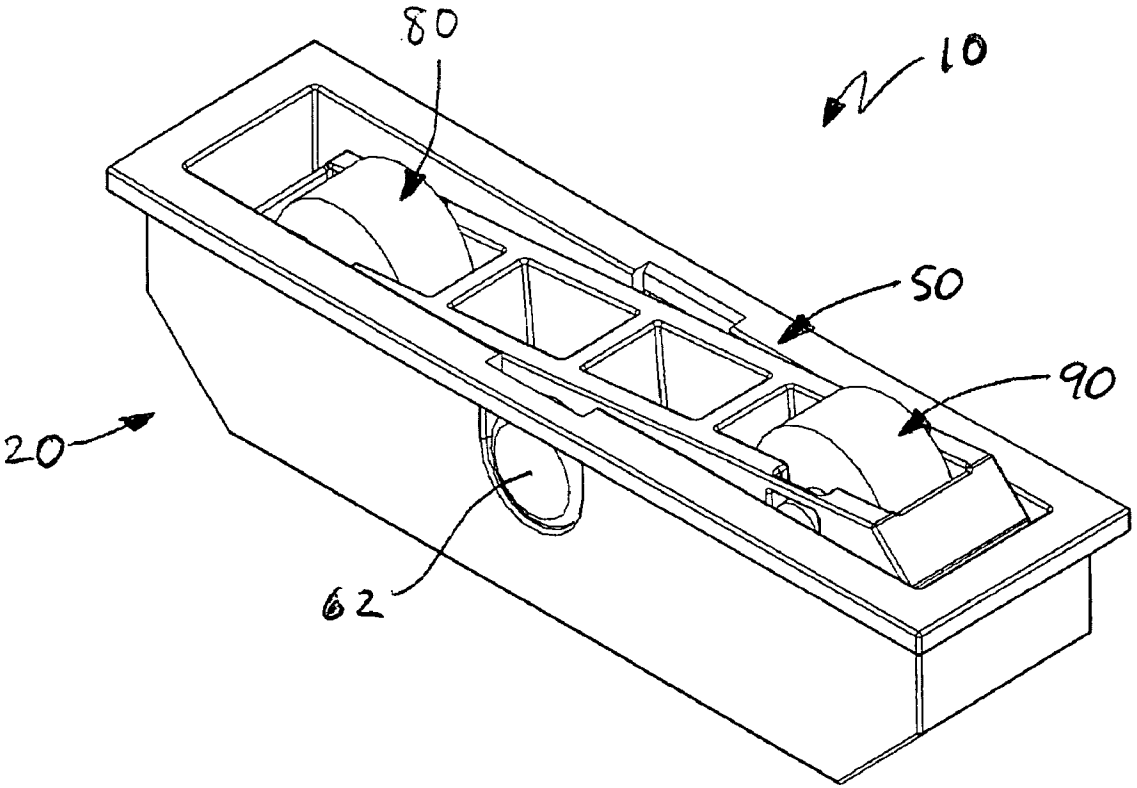
FIG. 1 is a perspective view of an exemplary embodiment of the invention.

In the exemplary embodiment as shown in FIG. 1, a window roller apparatus, generally denoted 10, according to aspects of the present invention comprises a cradle 20, a housing 50 pivotably installed in the cradle 20, at least two roller wheels 80, 90 rotatably installed in the housing 50, and a resilient pad 100 (FIG. 3) positioned between the cradle 20 and the housing 50 to effectively bias the housing 50 toward a parallel orientation relative to the cradle 20 while allowing for non-parallel operation of the housing 50 relative to the cradle 20 as dictated by operational constraints on the window roller apparatus 10, such as an out-of-square window frame or dirt or debris in the sash track, for example. While a particular exemplary construction of the window roller apparatus is shown and described, those skilled in the art will appreciate that the invention is not so limited, but instead that the aspects and principles of the invention may be practiced in a number of other alternative embodiments without departing from the spirit and scope of the invention.

Figure 2:
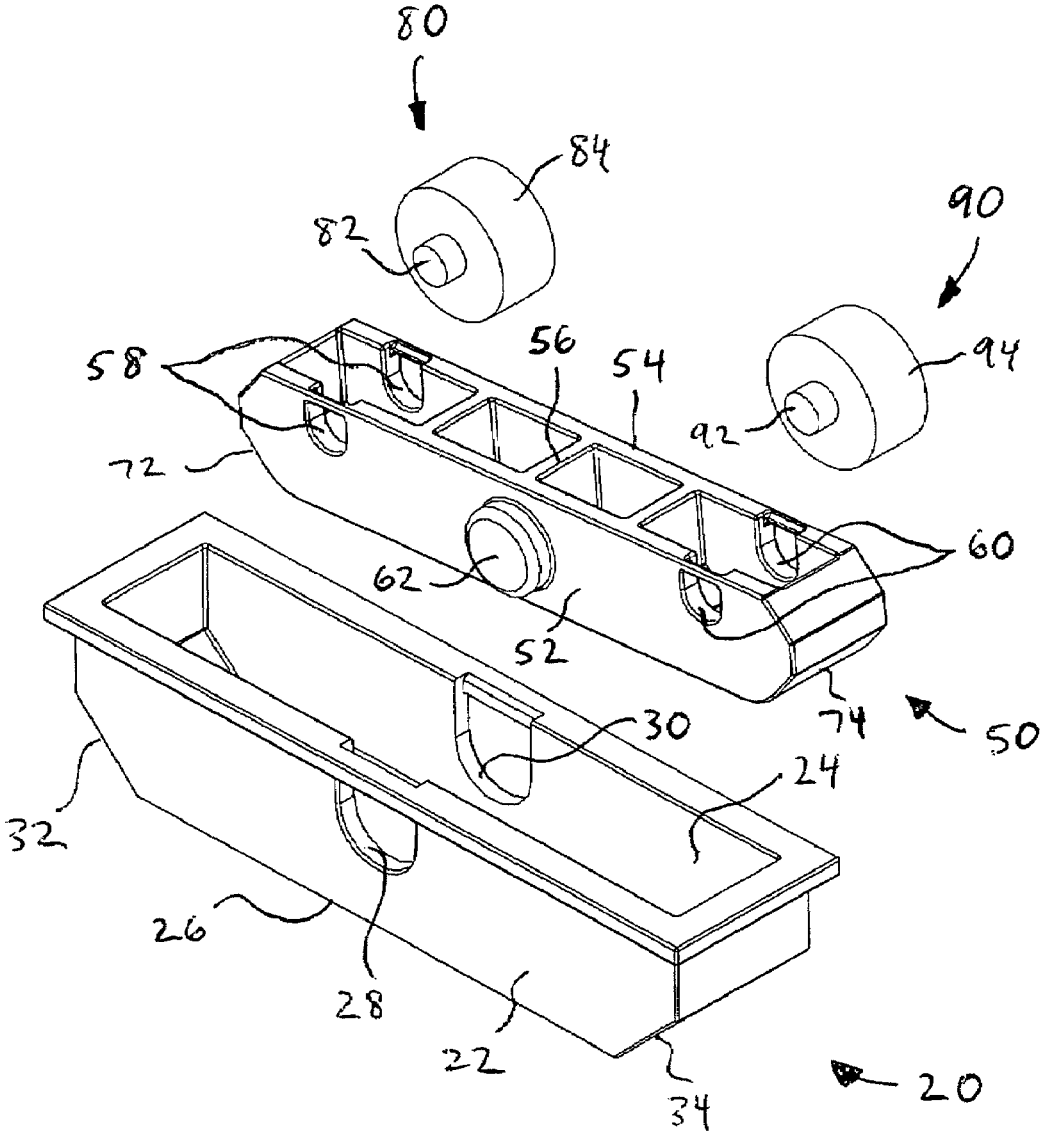
FIG. 2 is an exploded view thereof.

Referring now to FIG. 2, an exploded perspective view of the exemplary embodiment of the window roller apparatus 10 as shown in FIG. 1, the cradle 20 is shown as being formed having substantially parallel cradle side walls 22, 24 interconnected by a cradle bottom wall 26, the cradle side walls 22, 24 being formed with opposite inwardly-opening cradle side wall recesses 28, 30. The housing 50 is similarly formed having substantially parallel housing side walls 52, 54 interconnected by at least one housing intermediate wall 56, the housing side walls 52, 54 being formed with first and second sets of opposite inwardly-opening housing side wall recesses 58, 60. First and second roller wheels 80, 90 are rotatably installed in the housing 50 through engagement of respective first and second axles 82, 92 with the respective first and second sets of housing side wall recesses 58, 60. The housing side walls 52, 54 are further formed with opposite outwardly-projecting bosses 62, 64 configured to pivotably engage the respective inwardly-opening cradle side wall recesses 28, 30 such that the housing 50 is pivotably installed in the cradle 20. It will be appreciated by those skilled in the art that the components of the window roller apparatus 10 can be formed from a variety of materials and manufacturing and assembly processes now known and later developed without departing from the spirit and scope of the present invention. For example, the roller wheels 80, 90 may be made of brass or nylon through a molding, machining or casting process as appropriate for the selected material, with a number of possible finishing steps as well. The respective axles 82, 92 may be formed integral with the wheel portions 84, 94 of the roller wheels 80, 90, as through a molding or casting operation, or may be formed in a separate operation and then installed within the wheel portions 84, 94 by means such as press fit, threading, bonding, or over-molding. Both the cradle 20 and the housing 50 may also be formed of metal, plastic, or other suitable material employing any appropriate fabrication method now known or later developed. In such manufacturing and assembly processes, it will be further appreciated that while the cradle side wall recesses 28, 30 and the housing side wall recesses 58, 60 are shown as through-holes passing completely through the respective cradle side walls 22, 24 and housing side walls 52, 54, one or more of these recesses may in fact only be inset from the interior surface of the respective wall in which it is formed so as to form a nest for receipt of the housing bosses 62, 64, in the case of the cradle side wall recesses 28, 30, or the axles 82, 92, in the case of the housing side wall recesses 58, 60. It will also be appreciated that the upper cross-bar with ramped top wall as shown over each of the four recesses 58, 60 is optional depending on the type of roller wheels 80, 90 employed and other design considerations. By way of further illustration of an exemplary embodiment of the window roller apparatus of the present invention, the cradle side wall recesses 28, 30 may be located as shown substantially medially lengthwise within the respective cradle side walls 22, 24, and the bosses 62, 64, may be located substantially medially lengthwise along the respective housing side walls 52, 54, whereby the housing 50 then pivots substantially symmetrically within the cradle 20. Again, other such variations in construction are possible without departing from the spirit and scope of the invention.

Figure 3:
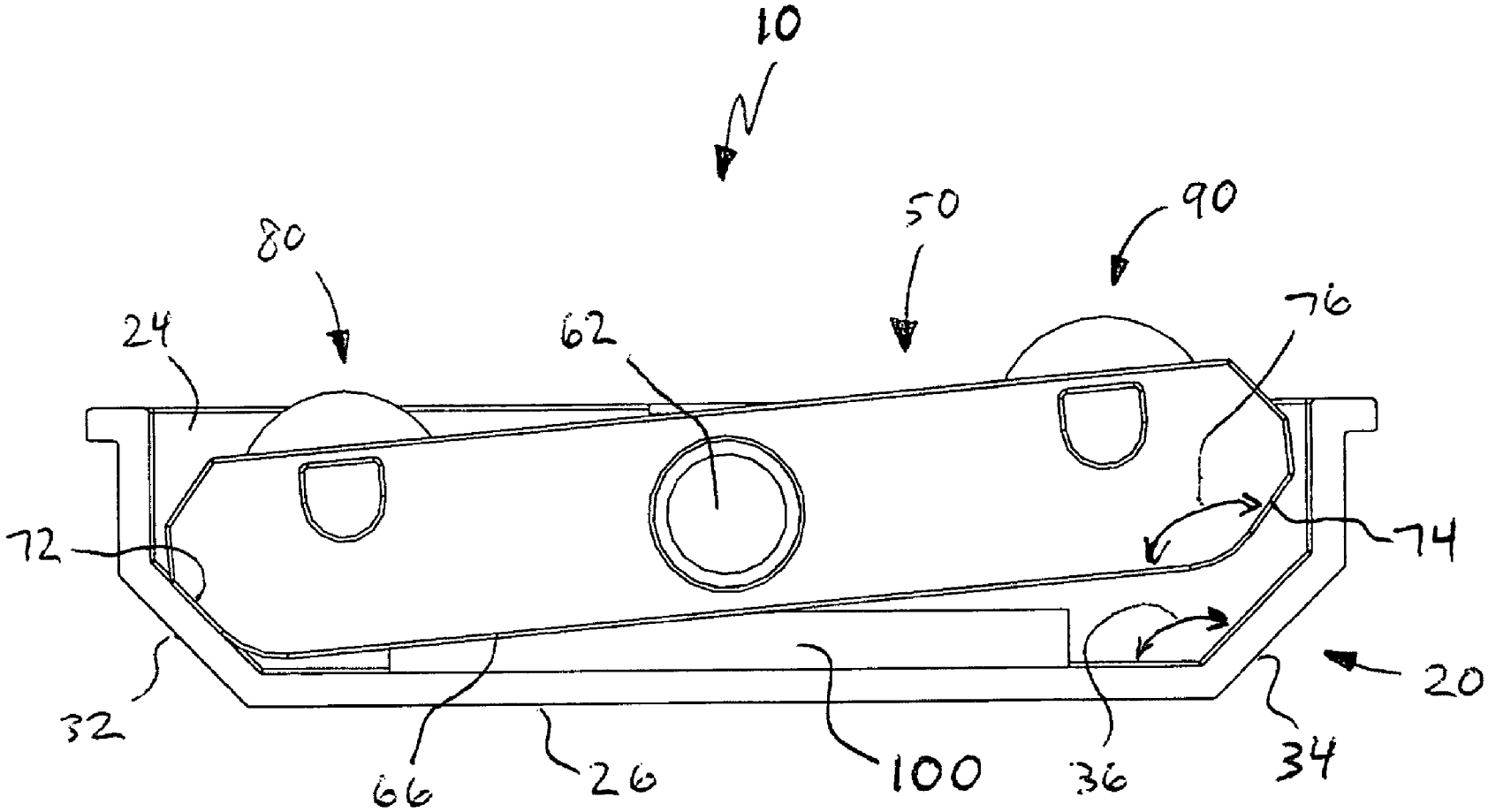
FIG. 3 is a schematic side view thereof.

With continued reference to FIGS. 1 and 2 and now with further reference to the side schematic view of FIG. 3, a side view of the window roller apparatus 10 with the closest cradle side wall 22 removed for clarity, the resilient pad 100 is shown as being positioned on the cradle bottom wall 26 between the cradle 20 and the housing 50. In the exemplary embodiment, the pad 100 is of a sufficient size and thickness to partially engage the housing 50, whereby the housing 50 is freely pivotable relative to the cradle 20 within the limitations of the resilient pad 100, the pad 100 effectively biasing the housing 50 toward a parallel orientation relative to the cradle 20 while allowing for non-parallel operation of the housing 50 relative to the cradle 20 as dictated by operational constraints on the window roller apparatus 10. That is, those skilled in the art will appreciate that windows being manufactured out of square or being installed out of square relative to the frame, movement of the frame after installation and use due to normal "wear and tear," to settling of the structure in which the window is installed, or to ground movement, or the accumulation of dirt, dust and/or debris in the window frame or window sash track are all contexts in which a sliding window operating on conventional rollers may cease to function optimally, if at all. While prior art solutions to such problems have typically involved manual adjustment of the height of one or both wheel roller assemblies, as for example by removing and reinstalling the wheel rollers in different slots or holes in the carrier or frame or by turning a screw or cam to effectively raise or lower one or both wheel rollers, this approach has the obvious downside of requiring proactive steps to be taken to remedy the misaligned or hanging window sash as it operates on its sliding track, a time-consuming and certainly inconvenient task. It will be appreciated that the window roller apparatus 10 of the present invention offers an advantage over such prior art window rollers by effectively being self-adjusting through the freely pivoting housing 50 within the cradle 20 and the biasing functionality of the resilient pad 100 between the housing 50 and cradle 20. In more detail, with the resilient pad 100 effectively wedged between the cradle 20 and the housing 50 and spanning both sides of the pivot point defined by the center axis of the opposite housing bosses 62, 64, as the housing 50 then pivots in either direction on the bosses 62, 64 relative to the cradle 20, as caused for example by an inconsistency in the sash track or an out-of-square window frame, the housing 50 is able to rock against the resistance of the resilient pad 100 so as to effectively automatically adjust the height of the wheel rollers 80, 90. When the obstruction or resistance to the sliding window frame or sash is cleared or removed, the biasing resilient pad 100 then returns the housing 50 to a substantially parallel orientation relative to the cradle 20. Once again, it will be appreciated by those skilled in the art that a variety of materials and geometries for the resilient pad 100 may be employed in the present invention without departing from its spirit and scope. In the exemplary embodiment, the resilient pad is a ⅛" thick foam that is approximately ⅜" wide and has a length that ranges from approximately 1" to 2½".

With still further reference to FIGS. 1-3, in the exemplary embodiment of the window roller apparatus 10 shown, the cradle side walls 22, 24 are further interconnected by opposite spaced-apart cradle end walls 32, 34 each being formed at an inclined obtuse cradle end wall angle 36 relative to the cradle bottom wall 26. Similarly, the housing side walls 52, 54 are further interconnected by a housing bottom wall 66 and opposite spaced-apart housing end walls 72, 74 each also being formed at an inclined obtuse housing end wall angle 76 relative to the housing bottom wall 66. Accordingly, it will be appreciated that during operation of the window roller apparatus 10 the range of pivoting motion of the housing 50 relative to the cradle 20 is absolutely limited in either direction through the engagement of the housing end walls 72, 74 with the respective cradle end walls 32, 34. Moreover, in the exemplary embodiment, the cradle end wall angle 36 is approximately one hundred thirty-five degrees, and the housing end wall angle 76 is slightly less than the cradle end wall angle 36, or is something less than approximately one hundred thirty-five degrees, whereby the pivoting relationship of the housing 50 relative to the cradle 20 in either direction alternately brings each housing end wall 72, 74 into substantially abutting contact with the respective cradle end wall 32, 34, thereby providing a rigid stop for the pivoting movement of the housing 50 within the cradle 20 in either direction about the bosses 62, 64. In one embodiment, the net effect of the operation of these stops functioning through the engagement of the housing end walls 72, 74 with the respective cradle end walls 32, 34 is a maximum effective height adjustment of the roller wheels 80, 90 through the pivoting of the housing 50 relative to the cradle 20 of approximately ⅛".

Figure 4:
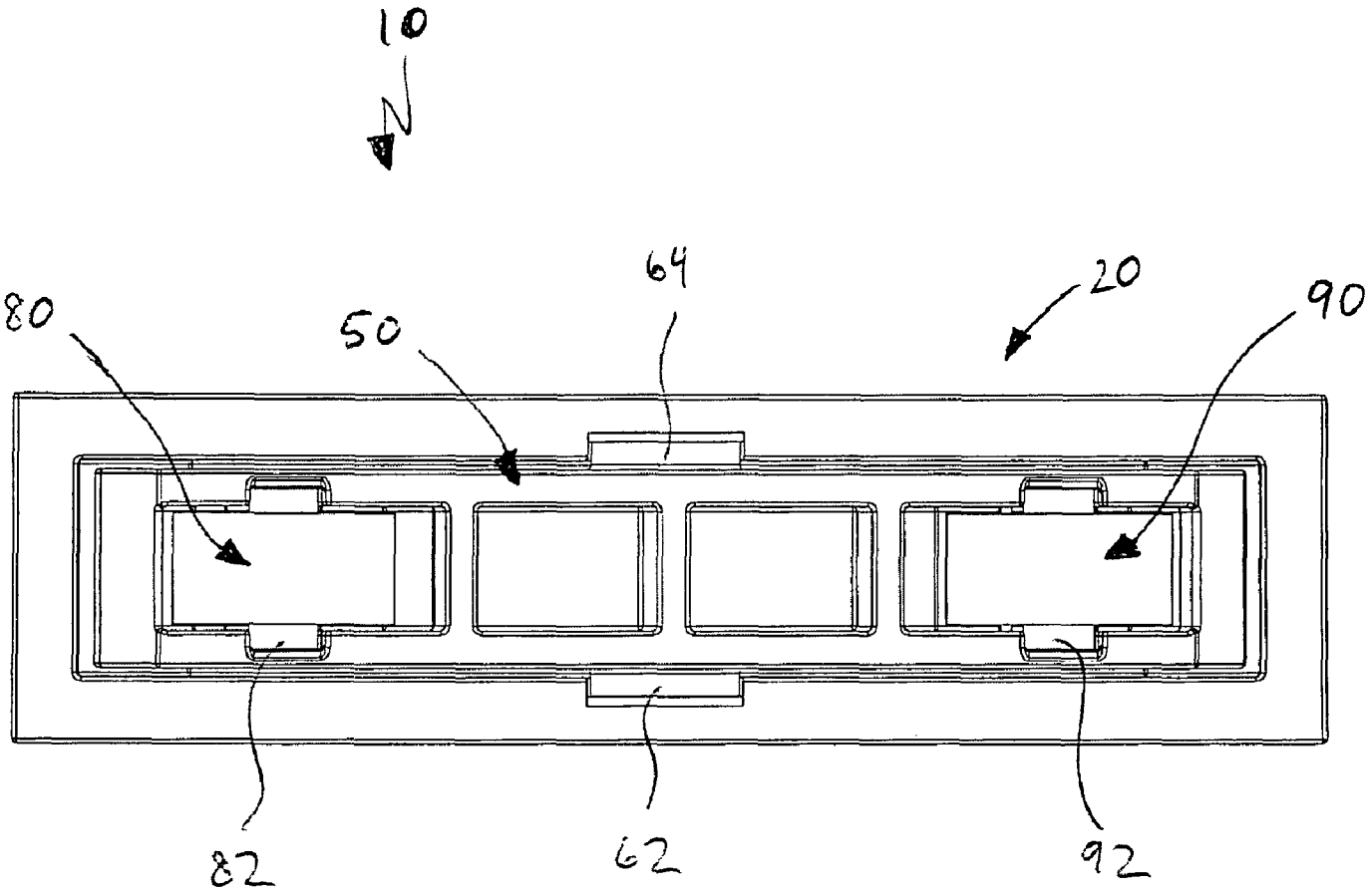
FIG. 4 is a top view thereof.
Figure 5:
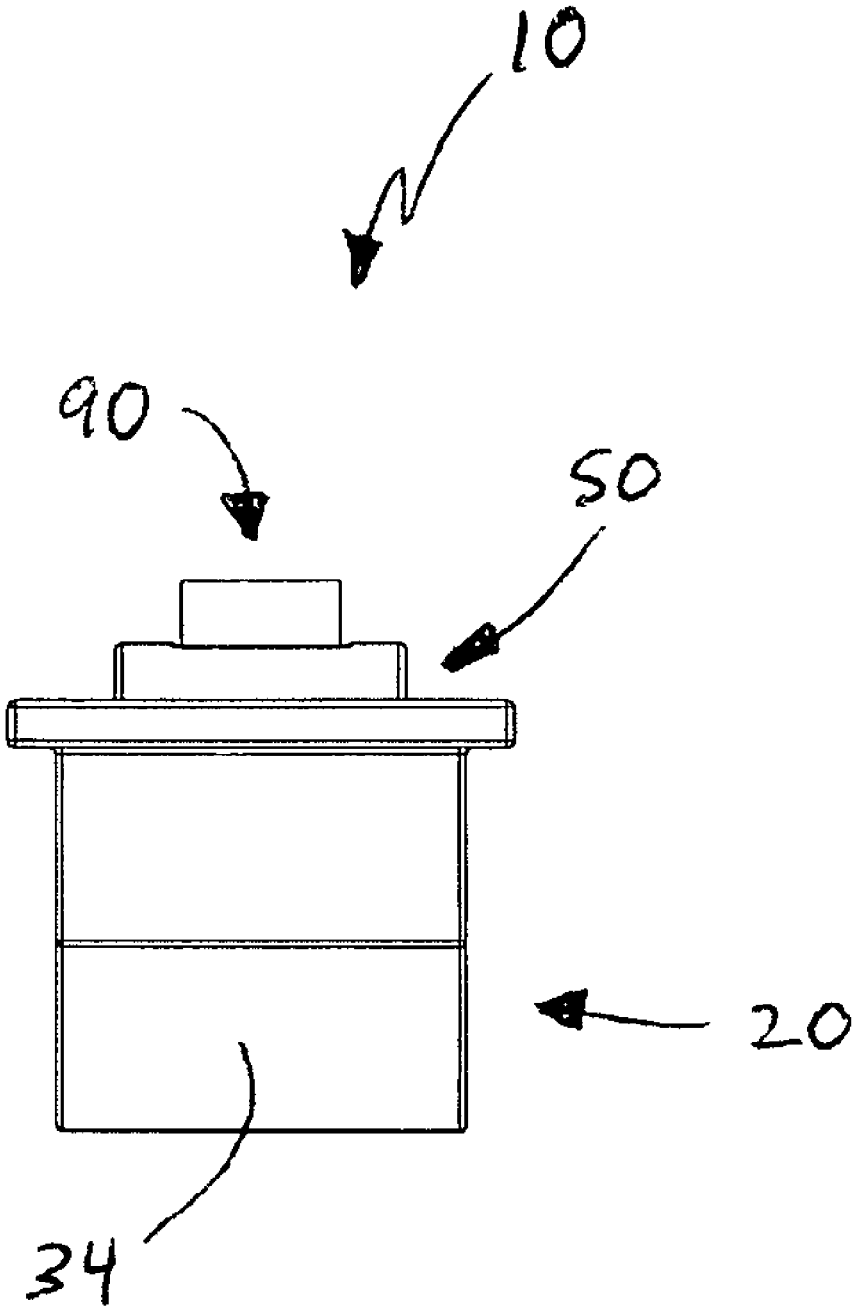
FIG. 5 is a an end view thereof.

Turning briefly to FIGS. 4 and 5, there are shown top and end views, respectively, of the window roller apparatus 10 of the present invention from which features not as readily visible in the other views of FIGS. 1-3 can be seen. For example, in FIG. 4 there can be seen the two offset bosses 62, 64 extending outwardly in substantially opposite directions from the respective housing side walls 52, 54. Once again, those skilled in the art will appreciate that while a particular configuration of the bosses 62, 64 and other geometrical features of the cradle 20, housing 50, and roller wheels 80, 90 are shown, the invention is not so limited. Accordingly, other means for pivoting the housing 50 relative to the cradle 20, and specifically for installing the housing 50 pivotably on or in the cradle 20, are possible without departing from the spirit and scope of the invention. From the end view of FIG. 5, the depth and overall proportionality of the window roller apparatus 10 can be readily ascertained, such as the width of the cradle end wall 34 and the height of the roller wheel 90 over the housing 50 and cradle 20 at the maximum adjusted position in one pivot direction as shown in the side schematic view of FIG. 3.

To summarize, in use, the self-adjusting window roller apparatus 10 of the present invention adjusts automatically for the clearance required for the sliding of a window sash or the like. Per the drawing figures discussed above, roller wheels 80, 90 made of brass, nylon, or other material are rotatably installed in a unique wheel housing 50 also made of metal, nylon or other plastic, or other such material. The housing 50 is then pivotably installed in a cradle 20 or frame or support structure, again made of metal, nylon or other plastic, or other such material, which is in turn installed in the bottom of the window sash (not shown) in a manner generally known in the art. As the roller wheels 80, 90 roll on the existing internal sash frame (not shown), the housing 50 within the cradle 20 is able to swing on its center axis, or the opposite bosses 62, 64, allowing the wheels 80, 90 to self-adjust up and down depending on the height and clearance required. The housing 50 is biased by a resilient pad 100 positioned between the housing 50 and the cradle 20 and is further limited in its pivotal movement by the stops incorporated in the geometry of the housing and the cradle end walls 32, 34, 72, 74. Since the roller wheels 80, 90 of the present invention are essentially free floating, there is no longer any need to adjust them once initially installed. The housing assembly 50 within the cradle 20 will automatically allow for any out-of-square or window warping issues or for any obstructions within the track, such as dirt, dust, or debris.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A window roller apparatus comprising:

a cradle having substantially parallel cradle side walls interconnected by a cradle bottom wall, the cradle side walls being formed with opposite inwardly-opening cradle side wall recesses;

a housing having substantially parallel housing side walls interconnected by at least one housing intermediate wall, the housing side walls being formed with first and second sets of opposite inwardly-opening housing side wall recesses, the housing side walls being further formed with opposite outwardly-projecting bosses configured to pivotably engage the respective inwardly-opening cradle side wall recesses such that the housing is pivotably installed in the cradle;

first and second roller wheels each having first and second axles, the first and second roller wheels being rotatably installed in the housing through engagement of the first and second axles with the respective first and second sets of housing side wall recesses; and a resilient pad positioned on the cradle bottom wall between the cradle and the housing, the pad being of a sufficient size and thickness to at least partially engage the housing, whereby the housing is freely pivotable relative to the cradle within the limitations of at least the pad, the pad effectively biasing the housing toward a parallel orientation relative to the cradle while allowing for non-parallel operation of the housing relative to the cradle as dictated by operational constraints on the window roller apparatus.

2. The apparatus of claim 1 wherein:

the cradle side wall recesses are located substantially medially lengthwise within the respective cradle side walls; and the bosses are located substantially medially lengthwise along the respective housing side walls, whereby the housing pivots substantially symmetrically within the cradle.

3. The apparatus of claim 1 wherein:

the cradle side walls are further interconnected by opposite spaced-apart cradle end walls, the cradle end walls each being formed at an inclined obtuse cradle end wall angle relative to the cradle bottom wall; and the housing side walls are further interconnected by a housing bottom wall and opposite spaced-apart housing end walls, the housing end walls each being formed at an inclined obtuse housing end wall angle relative to the housing bottom wall, whereby during operation of the window roller apparatus the range of pivoting motion of the housing relative to the cradle is absolutely limited in either direction through engagement of the housing end walls with the respective cradle end walls.

4. The apparatus of claim 3 wherein:

the cradle end wall angle is approximately one hundred thirty-five degrees; and the housing end wall angle is slightly less than the cradle end wall angle, whereby the pivoting relationship of the housing relative to the cradle in either direction alternately brings each housing end wall into substantially abutting contact with the respective cradle end wall, thereby providing a rigid stop for the pivoting movement of the housing within the cradle in either direction about the bosses.

5. The apparatus of claim 3 wherein the maximum effective height adjustment of the roller wheels through the pivoting of the housing relative to the cradle is approximately ⅛".

6. The apparatus of claim 1 wherein the resilient pad is made of foam.

7. The apparatus of claim 1 wherein the resilient pad is approximately ⅛" thick.

8. A window roller apparatus comprising:

a cradle having substantially parallel cradle side walls interconnected by a cradle bottom wall and by opposite spaced-apart cradle end walls, the cradle end walls each being formed at an inclined obtuse cradle end wall angle relative to the cradle bottom wall, the cradle side walls being formed with opposite inwardly-opening cradle side wall recesses;

a housing having substantially parallel housing side walls interconnected by opposite spaced-apart housing end walls, the housing side walls being formed with first and second sets of opposite inwardly-opening housing side wall recesses, the housing side walls being further formed with opposite outwardly-projecting bosses configured to pivotably engage the respective inwardly-opening cradle side wall recesses such that the housing is pivotably installed in the cradle, whereby during operation of the window roller apparatus the range of pivoting motion of the housing relative to the cradle is absolutely limited in either direction through engagement of the housing end walls with the respective cradle end walls;

first and second roller wheels each having first and second axles, the first and second roller wheels being rotatably installed in the housing through engagement of the first and second axles with the respective first and second sets of housing side wall recesses; and a resilient pad positioned on the cradle bottom wall between the cradle and the housing, the pad being of a sufficient size and thickness to at least partially engage the housing, whereby the housing is freely pivotable relative to the cradle within the resilient limitations of the pad and the absolute limitations of the engagement of the housing end walls with the respective cradle end walls, the pad effectively biasing the housing toward a parallel orientation relative to the cradle while allowing for non-parallel operation of the housing relative to the cradle as dictated by operational constraints on the window roller apparatus.

9. A method of automatically adjusting a window roller apparatus, comprising the steps of:

pivoting a housing having at least one roller wheel relative to a cradle through the engagement of opposite outwardly-projecting bosses formed on the housing with respective opposite inwardly-opening cradle side wall recesses; and biasing the housing toward a parallel orientation relative to the cradle while allowing for non-parallel operation of the housing relative to the cradle as dictated by operational constraints on the window roller apparatus through the positioning of a resilient pad between the cradle and the housing.

10. The method of claim 9 comprising the further step of absolutely limiting the range of pivoting motion of the housing relative to the cradle in either direction through engagement of housing end walls interconnecting opposite housing side walls of the housing with respective cradle end walls interconnecting opposite cradle side walls of the cradle.

* * * * *